United States Patent [19]

Laidler et al.

[11] 4,359,350

[45] Nov. 16, 1982

[54] HIGH POST-IRRADIATION DUCTILITY THERMOMECHANICAL TREATMENT FOR PRECIPITATION STRENGTHENED AUSTENITIC ALLOYS

[75] Inventors: James J. Laidler, Richland; Ronald R. Borisch, Kennewick, both of Wash.; Michael K. Korenko, Rockville, Md.

[73] Assignee: The United States of America as represented by the Department of Energy, Washington, D.C.

[21] Appl. No.: 248,121

[22] Filed: Mar. 27, 1981

[51] Int. Cl.[3] ..... C22F 1/10; C21D 6/02

[52] U.S. Cl. ..... 148/12.3; 148/12.7 R; 148/12.7 N

[58] Field of Search ..... 148/12.3, 12.7 R, 12.7 N, 148/11.5 N; 75/171, 134 N, 122

[56] References Cited

U.S. PATENT DOCUMENTS

| | | | |
|---|---|---|---|
| 3,473,973 | 10/1969 | Maekawa et al. | 148/12.3 |
| 3,573,109 | 3/1971 | Levy | 148/12.3 |
| 3,740,274 | 6/1973 | Chow | 148/12.3 |
| 4,225,363 | 9/1980 | Korenko | 148/12.7 N |

*Primary Examiner*—W. Stallard

*Attorney, Agent, or Firm*—R. A. Stoltz; J. J. Prizzi

[57] ABSTRACT

A method for improving the post-irradiation ductility is described which comprises a solution heat treatment following which the materials are cold worked. They are included to demonstrate the beneficial effect of this treatment on the swelling resistance and the ductility of these austenitic precipitation hardenable alloys.

3 Claims, No Drawings

HIGH POST-IRRADIATION DUCTILITY THERMOMECHANICAL TREATMENT FOR PRECIPITATION STRENGTHENED AUSTENITIC ALLOYS

The invention was made or conceived during the performance of work under Contract No. EC-76-C-14-2170 with the Department of Energy.

The present invention relates to a method of improving the post-irradiation ductility of precipitation hardenable alloys.

BACKGROUND OF THE INVENTION

The present invention relates to a method of improving the post-irradiation ductility of precipitation hardenable alloys and more particularly to those alloys which undergo a gamma prime hardening precipitation reaction. In general, it has been found that these alloys develop an optimum combination of strength and ductility when they are solution heat treated and precipitation hardened, such solution heat treating usually taking place at a temperature in excess of about 950° C., following which the alloy is usually quenched to room temperature from such solution heat treatment temperature. It is a function of the solution heat treatment temperature to place into solid solution all of the components which will enter into the precipitation hardening mechanism. In this case, the iron-nickel-chromium matrix in its austenitic phase configuration is the solid solution into which such components as titanium and aluminum are taken into said solid solution. Following quenching to room temperature the alloys are heated usually to a temperature between about 600° C. and about 825° C. for discrete periods of time during which the titanium, aluminum and nickel are precipitated from the solid solution usually in the form of $Ni_3(Ti, Al)$. This configuration is known as the gamma prime configuration and is effective for rendering the alloy with its optimum combination of strength and ductility.

In contrast thereto, the present invention has unexpectedly found that following solution heat treatment, which advantageously renders the alloy in its most workable condition, the alloy can be cold worked to effect a reduction in cross-sectional area of between about 10% and about 60% and, as cold worked, the alloy will exhibit sufficient strength and post-irradiation ductility as to make the composition of matter highly desirable for use in a nuclear reactor where the components are subject to high fluences during the operation of the reactor.

DETAILED DESCRIPTION

The present invention is directed to a method of improving the post-irradiation ductility of an alloy having a composition which usually falls within the range between about 25% and about 45% nickel, about 8% and about 15% chromium, up to 3.5% molybdenum, from about 0.3% to about 3.5% titanium, from about 1.5% to about 3.5% aluminum, up to 1% silicon, up to 1% zirconium, up to 4% niobium, up to 0.01% boron, up to 0.05% carbon and the balance essentially iron with incidental impurities. An alloy having a composition falling within the foregoing range will, upon heat treatment, undergo a gamma prime precipitation hardening mechanism. The gamma prime will be precipitated from the austenitic phase of the alloy and when so precipitated and substantially distributed throughout the austenitic matrix, will provide the alloy with an optimum combination of strength and ductility. The precipitation hardening reaction is initiated by the alloy being subjected to a solution heat treatment temperature, usually at a temperature within the range between about 950° C. and about 1150° C., following which the alloy after all of the components are in solution is quenched to room temperature. Following the quenching to room temperature, the alloy is subjected to one or more aging treatments, usually at a temperature within the range between about 600° C. and about 850° C. for a time period usually of up to about 24 hours. Such aging heat treatment has the effect of precipitating the gamma prime phase which is usually viewed as $Ni_3(Ti,Al)$ in a fairly uniform manner within the grains of the alloy. As this precipitation hardened, the allow will have optimum strength combined with optimum ductility, the same as is measured by both the stress rupture tests as well as the short time tensiletests. Unfortunately alloys when in this condition and which are thereafter subjected to the influence of neutron irradiation, for example in the environment of a nuclear reactor, will undergo drastic changes in the observed mechanical properties. Foremost among these is the fact that the alloy will swell and as a result change its density. In addition thereto it has been found that these materials which had heretofore exhibited good ductility now become quite brittle after they have been subjected to the neutron influence in a nuclear reactor. Unexpectedly it has been found that where these same materials are subjected to the standard solution heat treatment temperature and thereafter cold worked to effect a reduction in cross-sectional area of between about 10% and about 60% and thereafter in the cold worked condition are subjected to the same neutron influence, not only is there observed a great improvement in the swelling characteristics of these alloys but more importantly these same alloys after irradiation will show a high degree of ductility, especially as measured by the disk bend test.

Thus the method of the present invention for improving the post-irradiation ductility includes a solution heat treatment at a temperature within the range between about 950° C. and about 1150° C. for a time period of up to about one hour. Thereafter, the solution heat treated alloy is subject to cold working to effect a reduction in the cross-sectional area of between about 10% and about 60% and more preferably within the range between about 15% and about 30%. Outstanding results have been achieved where the cold working effects a reduction in cross-sectional area of between about 20% and about 25%. It is immaterial how the cold working is effected. In this regard it should be noted that where a flat product is desired the alloy in its solution heat treated form can be cold rolled to effect a reduction in the cross-sectional area within the limits set forth hereinbefore, usually by just reducing the gauge of the material. On the other hand, for example, where a tube type product is required, such cold working can be effected by drawing the tube through a die with a mandrel placed between the die opening and the tube, as is well known in the art. Since the alloy is in its solution heat treated condition, the cold work ability of the alloy is usually optimum so that these reductions in area can be readily achieved without the necessity for interposing a stress relieving heat treatment to the underlying alloy. In order to more clearly demonstrate the improvement in the post-irradiation ductility, reference may be had to Table I which describes the effects of cold working in reducing the swelling in the precipitation hardening alloys. The column headed "$\phi_t$" is the total fluence to which these alloys have been irradiated and the temperature column indicates the temperature of irradiation. The last column shows the percentage of density change and the indication STA is the prior art heat treatment which includes a solution heat treatment following aging, whereas the CW indicates the cold working of either 25% or 30%.

TABLE I

| Alloy | $\phi_t$* | Temp. (°C.) | $\Delta\rho/\rho°$ (%) |
|---|---|---|---|
| D21 (STA) | 6.6 | 428 | 0.59 |
| | 6.3 | 482 | 0.57 |
| | 7.3 | 510 | 4.5 |
| D21 (CW) | 5.8 | 427 | −.59 |
| | 5.2 | 482 | −.85 |
| | 6.6 | 510 | −.78 |
| D66 (STA) | 6.6 | 427 | 0.58 |
| | 7.3 | 510 | 0.01 |
| D66 (CW) | 5.8 | 427 | −1.16 |
| | 6.6 | 510 | −.79 |
| A286 (STA) | 4.3 | 427 | 2.16 |
| | 5.1 | 510 | 1.37 |
| A286 (CW) | 6.6 | 427 | −0.64 |
| | 7.3 | 510 | −0.41 |

*$10^{22}$ n/cm$^2$ (E 0.1 MeV)
STA = Solution Treated and Aged
CW = Cold Worked By inspection of the data contained in Table I it is noted that there is a slight densification of the alloys after irradiation when they are in the cold worked condition. This is indicated by the negative values and as such will demonstrate the fact that the treatment of the present invention is effective for reducing the swelling tendency of these alloys when they are subject to the neutron irradiation influence. Perhaps the most outstanding data however concern the disk bend test. These materials as detailed in Table II were subjected to the heat treatments contained therein and the bend ductility results clearly demonstrate the outstanding nature of this thermomechanical treatment.

TABLE II

| Alloys | HT Code | Composition | TMT | Bend Ductility (%) T.T. = I.T. + 110° C. I.T. = 500 | 550 | 600 |
|---|---|---|---|---|---|---|
| D66 | EE | Fe—45Ni—12Cr—3.0Mo—25Ti—2.5Al—0.5Si—0.50Zr—0.005B—0.03C | 60% CW + 800° C./11 hr/AC + 700° C./2 hr/AC | 0.14 | | |
| D66 | LJ | | 1050° C./0.4 hr + 60% CW | 0.40 | 0.60 | |
| D66 | LK | | 1050° C./0.5 hr + 60% CW + 960° C./0.5 hr | | | 0.28 |
| D66 | LN | | 1050° C./0.5 hr + 60% CW + 1050° C./0.5 hr | | | 0 |
| D66 | LR | | 1050° C./0.5 hr + 60% CW + 1150° C./0.5 hr | | | 0.20 |
| D21 | LO | Fe—58.5Ni—25.0Cr—8.4Mo—1.0Si—1.0Mn—1.0Ti—3.3Al—1.7Nb 0.05C—0.04B—0.001 | 1050° C./0.5 hr + 30% CW | >0.50 | 0.61 | 0.81 |
| D21 | L1 | | 1050° C./0.5. hr + 30% CW + 950° C./0.5 hr | | | 0.36 |
| D21 | L3 | | 1050° C./0.5 hr + 30% CW + 1050° C./0.5 hr | | | 0 |
| D21 | L5 | | 1050° C./0.5 hr + 30% CW + 1150° C./0.5 hr | | | 0 |
| D68 | LU | Fe—36.0Ni—45.0Cr—12.0Mo—0.1Si—0.4Mn—0.3Ti—1.8Al—0.4Nb—3.6C—0.03B—0.005 | 1050° C./0.5 hr + 60% CW | | | 0.30 |
| D68 | LV | | 1050° C./0.5 hr + 60% CW + 950° C./0.5 hr | | | 0 |
| D68 | N2 | | 1050° C./0.5 hr + 60% CW + 1150° C./0.5 hr | | | 0 |
| D68 | NB | | 1050° C./0.5 hr + 60% CW + 1050° C./0.5 hr + 750° C./1 hr | | | 0 |
| D68 | NC | | 1050° C./0.5 hr + 60% CW + 1050° C./0.5 hr + 750° C./3 hr | | | 0.16 |
| D68 | NE | | 1050° C./0.5 hr + 60% CW + 1050° C./0.5 hr + 750° C./48 hr | | | 0.15 |

From the foregoing it becomes clear that these materials, when subjected to the influence of the neutron irradiation, perform exceptionally well. Further it is noted that while the alloy will have the strength characteristics necessary, usually as a result of strain aging because of the cold working, the ductility as exhibited by the disk bend test as well as the swelling resistance shows such improvement over and above that condition of solution heat treatment plus precipitation hardening which has been utilized in the prior art alloys.

We claim:

1. The method of improving the post-irradiation ductility of precipitation hardenable alloys, the steps comprising solution heat treating the alloys at a temperature within the range between about 950° C. and about 1150° C. and thereafter cold working the alloys to effect a reduction in cross-sectional area of between about 10% and about 60%.

2. The method according to claim 1 which is characterized by cold working to effect a reduction in cross-sectional area of between about 15% and about 30% by cold rolling.

3. The method according to claim 1 which is characterized by cold working to effect a reduction in cross-sectional area of between about 20% and about 25%.

* * * * *